US006570573B1

(12) United States Patent
Kazachinsky et al.

(10) Patent No.: US 6,570,573 B1
(45) Date of Patent: May 27, 2003

(54) METHOD AND APPARATUS FOR PRE-FETCHING VERTEX BUFFERS IN A COMPUTER SYSTEM

(75) Inventors: Itamar S. Kazachinsky, Natanya (IL); Zeev Offen, Haifa (IL)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/505,926

(22) Filed: Feb. 14, 2000

(51) Int. Cl.[7] ..... G09G 5/36
(52) U.S. Cl. ..... 345/558; 345/536; 711/136
(58) Field of Search ..... 345/501, 503, 345/558, 557, 536, 543, 564, 522, 520, 566; 711/118, 133, 136

(56) References Cited

U.S. PATENT DOCUMENTS

| | | | | | |
|---|---|---|---|---|---|
| 5,557,733 | A | * | 9/1996 | Hicok et al. | 345/554 |
| 5,706,478 | A | * | 1/1998 | Dye | 345/503 |
| 5,861,893 | A | * | 1/1999 | Sturgess | 345/562 |
| 6,073,210 | A | * | 6/2000 | Palanca et al. | 711/118 |
| 6,078,339 | A | * | 6/2000 | Meinerth et al. | 345/522 |
| 6,433,787 | B1 | * | 8/2002 | Murphy | 345/556 |

* cited by examiner

*Primary Examiner*—Kee M. Tung
(74) *Attorney, Agent, or Firm*—Blakely, Sokoloff, Taylor & Zafman LLP

(57) ABSTRACT

According to one embodiment, a computer system includes a memory and a central processing unit (graphics accelerator) coupled to the memory. The graphics accelerator is adaptable to process three-dimensional (3D) graphics primitives stored in the memory according to an inline streaming mode and an indirect streaming mode.

33 Claims, 11 Drawing Sheets

METHOD AND APPARATUS FOR PRE-FETCHING VERTEX BUFFERS IN A COMPUTER SYSTEM

FIELD OF THE INVENTION

The present invention relates to computer systems; more particularly, the present invention relates to processing three-dimensional graphics.

BACKGROUND

Computer systems that include an Unified Memory Architecture (UMA) combine the functionality of a main memory subsystem and a graphics local memory subsystem. Computer systems with a UMA are obviously less expensive to manufacture due to the absence of a second memory controller (i.e., the graphics memory controller). Three-dimensional graphics applications in an UMA typically requires the referencing of vertex buffers from the unified memory in order to access a series of vertices included in graphics primitives. Most graphics computer systems access the vertex buffers using inline command streams. However, systems that utilize inline command streams typically need to quote the entire vertex data inside the graphics command stream. However, quoting the entire vertex does not efficiently use memory bandwidth, which is especially critical in a UMA graphics system.

One problem is that whenever a graphics frame is rendered, each vertex must be copied from memory into the graphics command stream, stored in another location in memory, before it is read by a graphics accelerator. Another problem is due to the fact that most vertices are reused since each vertex is part of more than one uniplanar triangle. Therefore, the vertices can be cached for later processing at the graphics accelerator. Therefore, a method and apparatus for accessing a vertex buffer using indirect command streams is desired.

BRIEF DESCRIPTION OF THE DRAWINGS

The present invention will be understood more fully from the detailed description given below and from the accompanying drawings of various embodiments of the invention. The drawings, however, should not be taken to limit the invention to the specific embodiments, but are for explanation and understanding only.

DETAILED DESCRIPTION

Figure 1:
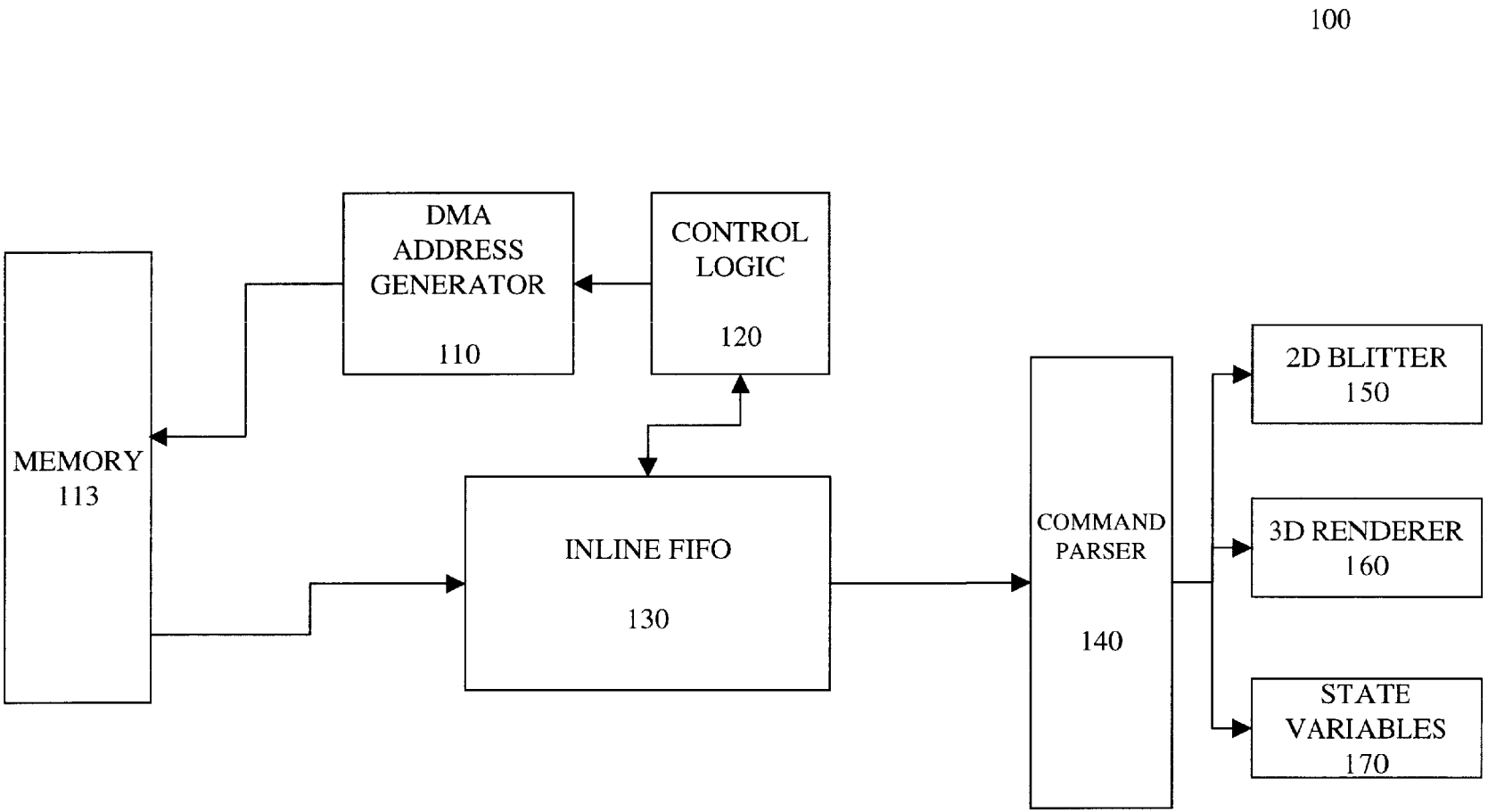
FIG. 1 (PRIOR ART)
FIG. 1 is a block diagram of an exemplary system for implementing graphics processing.

A method and apparatus for pre-fetching vertex buffers is described. In the following detailed description of the present invention numerous specific details are set forth in order to provide a thorough understanding of the present invention. However, it will be apparent to one skilled in the art that the present invention may be practiced without these specific details. In other instances, well-known structures and devices are shown in block diagram form, rather than in detail, in order to avoid obscuring the present invention.

Some portions of the detailed descriptions that follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present invention, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, and magneto-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general-purpose machines may be used with programs in accordance with the teachings herein, or it may prove convenient to construct more specialized apparatus to perform the required method steps. The required structure for a variety of these machines will appear from the description below. In addition, the present invention is not described with reference to any particular programming language. It will be appreciated that a variety of programming languages may be used to implement the teachings of the invention as described herein.

The programs including executable instructions may be executed by one or more programming devices (e.g., a central processing unit (CPU), processor, controller, etc.) in one or more personal computer systems, servers, workstations, etc.

FIG. 1 is a block diagram of an exemplary system 100 for implementing graphics processing. System 100 includes a memory 113, a direct memory access (DMA) address generator 110, control logic 120, an inline first in-first out buffer (FIFO) 130 and a command parser 140. Also included in system 100 is a two-dimensional (2D) blitter 150, a three-dimensional (3D) renderer 160, and state variables 170.

During typical operation of system 100, commands to access memory 113 for graphics functions (e.g., 3D rendering) are buffered in FIFO 130. Typically, each command includes an operation code (op-code). Inline commands stored in FIFO 130 do not include the address in memory 113 for the vertex data. Instead, the vertex data is explicitly quoted in the command line.

As a particular command is ready to be transmitted from FIFO 130 to be executed, control logic 120 tracks the status of FIFO 130 and determines whether the next line from memory 113 should be requested. Address generator translates the request stored in FIFO 130 to the actual address in memory 113 in which vertices of graphics data is stored. Address generator 110 generates consecutive addresses within the limits of a command buffer in memory 113. The start/end limits of the command buffer are known in advance based upon programmable registers (not shown). Once the vertex data is retrieved from memory 113, the data and the op-code is transmitted to command parser 140. Command parser 140 receives the data from FIFO 130 and subsequently forwards the data for execution (e.g., to 3D renderer).

The problem with system 100 is that in order to access a series of vertices stored in memory 113 for rendering graphics primitives, inline command streams are used. As described above, inline command streams do not make efficient use of memory 113 bandwidth since the entire data of the vertices inside the graphics command stream must be quoted.

Figure 2:
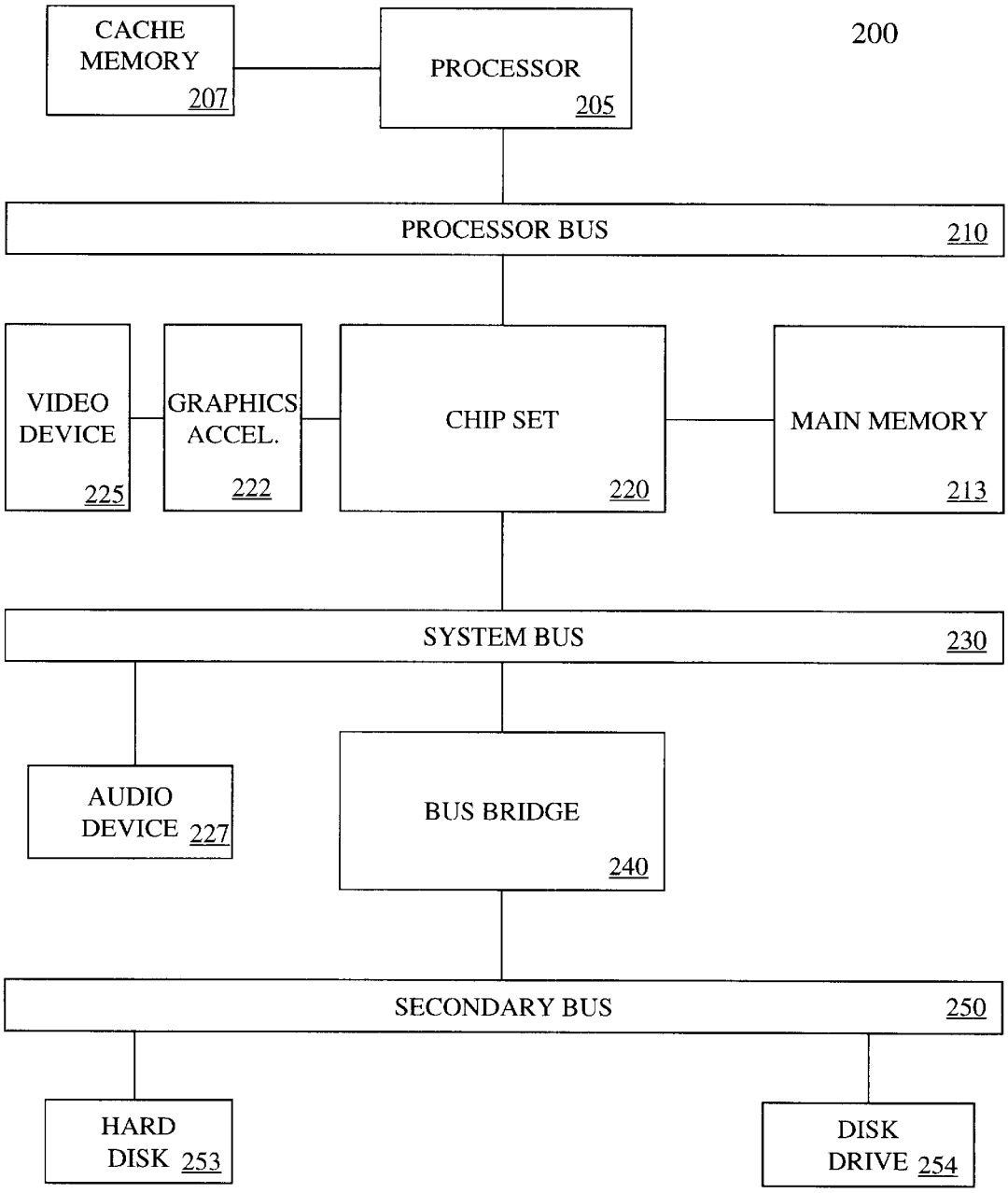
FIG. 2 is a block diagram of one embodiment of a computer system.

FIG. 2 is a block diagram of one embodiment of a computer system 200 for executing both inline and indirect command streams. Computer system 200 includes a central processing unit (processor) 205 coupled to processor bus 210. In one embodiment, processor 205 is a processor in the Pentium® family of processors including the Pentium® II family and mobile Pentium® and Pentium® II processors available from Intel Corporation of Santa Clara, Calif. Alternatively, other processors may be used. Processor 205 may include a first level (L1) cache memory (not shown in FIG. 1).

In one embodiment, processor 205 is also coupled to cache memory 207, which is a second level (L2) cache memory, via a dedicated cache bus. The L1 and L2 cache memories can also be integrated into a single device. Alternatively, cache memory 207 may be coupled to processor 205 by a shared bus. Cache memory 207 is optional and is not required for computer system 200.

Chip set 220 is also coupled to processor bus 210. Chip set 220 may include a memory controller for controlling a main memory 213. In one embodiment, chip set 220 operates according to an Unified Memory Architecture (UMA). Further, chipset 220 may also include an Accelerated Graphics Port (AGP) Specification Revision 2.0 interface developed by Intel Corporation of Santa Clara, Calif. Chip set 220 is coupled to a graphics accelerator 222. According to one embodiment, graphics accelerator 222 process graphics data received at computer system 200.

Main memory 213 is coupled to processor bus 210 through chip set 220. Main memory 213 and cache memory 207 store sequences of instructions that are executed by processor 205 and/or graphics accelerator 222. In one embodiment, main memory 213 includes a dynamic random access memory (DRAM) system; however, main memory 213 may have other configurations. The sequences of instructions executed by processor 205 may be retrieved from main memory 213, cache memory 207, or any other storage device. Additional devices may also be coupled to processor bus 210, such as multiple processors and/or multiple main memory devices. Computer system 200 is described in terms of a single processor; however, multiple processors can be coupled to processor bus 210. Video device 225 is coupled to graphics accelerator 222. In one embodiment, video device includes a video monitor such as a cathode ray tube (CRT) or liquid crystal display (LCD) and necessary support circuitry.

Processor bus 210 is coupled to system bus 230 by chip set 220. In one embodiment, system bus 230 is a Peripheral Component Interconnect (PCI) Specification Revision 2.1 standard bus developed by Intel Corporation of Santa Clara, Calif.; however, other bus standards may also be used. Multiple devices, such as audio device 227, may be coupled to system bus 230.

Bus bridge 240 couples system bus 230 to secondary bus 250. In one embodiment, secondary bus 250 is an Industry Standard Architecture (ISA) Specification Revision 1.0 a bus developed by International Business Machines of Armonk, N.Y. However, other bus standards may also be used, for example Extended Industry Standard Architecture (EISA) Specification Revision 3.12 developed by Compaq Computer, et al. Multiple devices, such as hard disk 253 and disk drive 254 may be coupled to secondary bus 250. Other devices, such as cursor control devices (not shown in FIG. 1), may be coupled to secondary bus 250.

Figure 3:
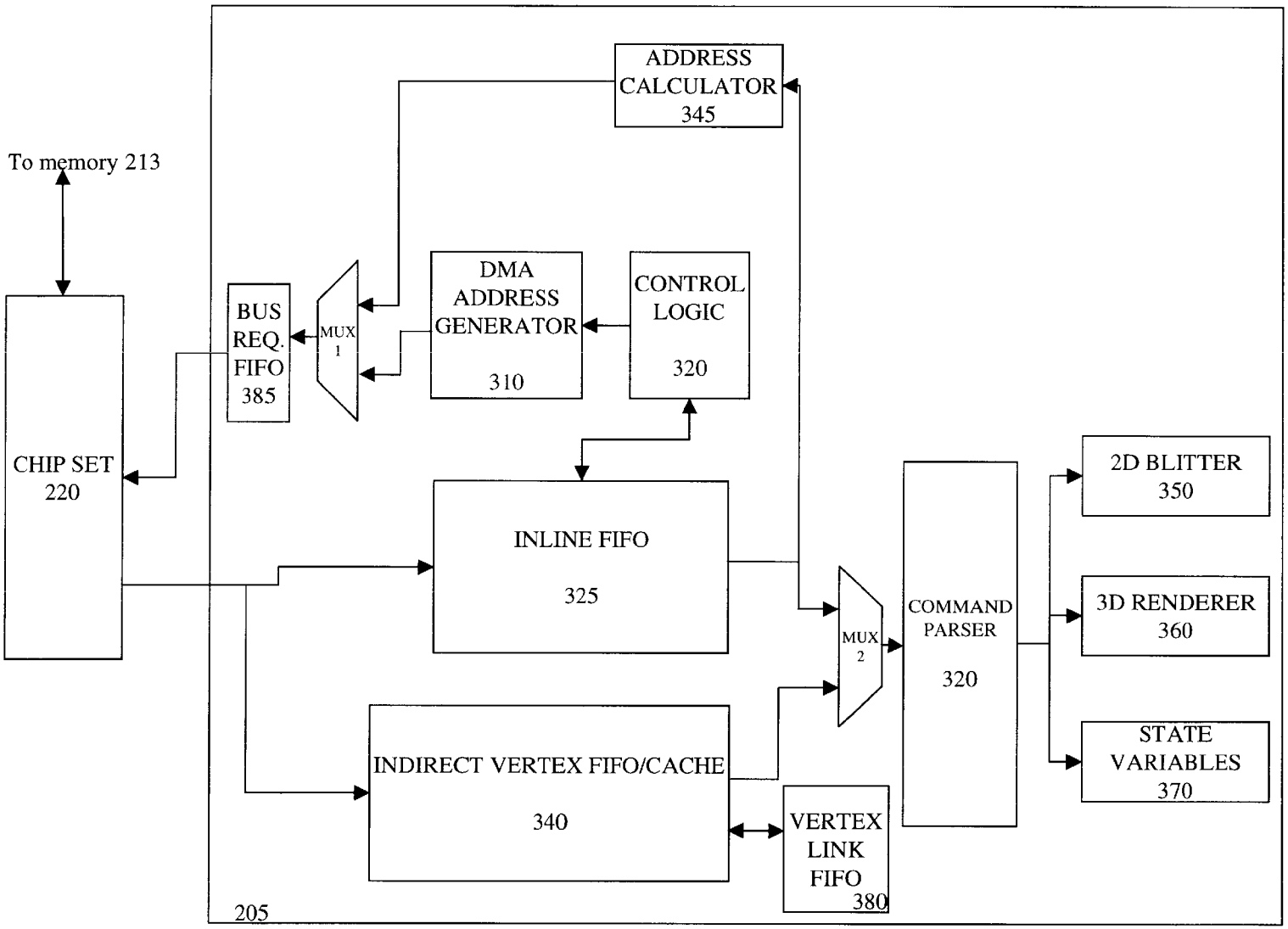
FIG. 3 is a block diagram of one embodiment of a graphics accelerator.

FIG. 3 is a block diagram of one embodiment of graphics accelerator 222 coupled to via chip set 220. According to one embodiment, graphics accelerator 222 is adaptable to execute 3D graphics commands in both inline and indirect streaming modes. 3D graphics primitives include a series of vertices stored in memory 213. The number of bytes of vertex data (e.g., vertex size) may vary between primitives, but is constant within a primitive. Inline vertices are typically quoted as part of a 3D primitive command, while indirect vertices may reside in a separate memory location and be referenced by the graphics command. For indirect commands the op-code is followed by an implicit (indirect) reference to the vertex data through either explicit (absolute) addresses or implicit pointers (indices). The indirect vertices may be stored in a memory location within memory 213 referred to as a vertex buffer (or vertex pool).

According to one embodiment, indirect vertices may be referenced by the graphics command according to one of two access modes, random or sequential. Randomly arranged indirect primitives (e.g., random indirect streaming) are referenced by a series of pointers inside the graphics command, each pointing to another location in which a vertex starts in the vertex buffer. Sequentially arranged indirect primitives (e.g., sequential indirect streaming) are referenced through a single pointer, which points to the location in the vertex buffer in which the first vertex starts, followed by a sequence size parameter, which defines the number of sequential vertices in the vertex buffer that form the primitive.

According to one embodiment, both the random and the sequential pointers are derived from either the absolute pointer or relative indexed pointer, known also as vertex buffer addressing modes. Absolute pointers are 32-bit linear addresses while indexed pointers are 16-bit indices referring to a vertex in the vertex buffer. Absolute addressing allows for access of more than $2^{16}$ vertices in a single vertex buffer, as limited by the width of the indices.

Referring to FIG. 3, graphics processor 222 includes an address generator 310 coupled to chip set 220 via multiplexer (MUX) 1, control logic 320 coupled to address generator 310, an inline FIFO 325 coupled to control logic 320 and chip set 220, and a command parser 330 coupled to FIFO 325 via MUX 2. Also included in graphics accelerator 222 is an indirect vertex FIFO/cache 340 coupled to chip set 220 and command parser 330 via MUX 2 and an address calculator 345 coupled to FIFO 325. Further included in graphics accelerator 222 is a two-dimensional (2D) blitter 350, a three-dimensional (3D) renderer 360 and state variables 370. In addition, graphics accelerator 222 includes a vertex link FIFO 380 coupled to FIFO/cache 340, and a bus request FIFO 385 coupled to address calculator 345.

Address generator 310 translates requests stored in FIFO 325 to the actual address in memory 113 in which vertices of graphics data is stored. According to one embodiment, address generator 310 is a direct memory access (DMA) address generator. Control logic 320 receives the memory address from FIFO 325 for retrieving vertex data in the inline streaming mode. FIFO 325 buffers graphics commands to access memory 213. According to one embodiment, FIFO 325 stores the op-code for the command, the type of vertex stream (e.g., inline or indirect), and the storage information for the vertices. According to one embodiment, FIFO 325 is a DMA FIFO. Command parser 330 deciphers the op-code received from FIFO 325 and forwards the command and vertex data to be executed.

According to one embodiment, when command parser 330 detects an indirect vertex buffer inside the inline command stream a command referencing, graphics accelerator 222 switches into the indirect streaming mode. Graphics accelerator 222 stays in this mode as long as the command and all its vertex data are fetched and processed, and then it switches back to the default inline mode. Once in indirect streaming mode the new indirect streamer decodes the command header and determines the access mode (e.g., whether it has to fetch a sequential or random primitive).

According to one embodiment, indirect vertex FIFO/cache 340 serves as a second FIFO buffer for storage of indirect vertices and commands in the sequential indirect streaming mode. Further, indirect vertex FIFO/cache 340 operates as a cache in the random indirect streaming mode. Address calculator logic 345 calculates the position of the first vertex and the number of vertices to be fetched from memory 213 during an indirect streaming command. Bus request FIFO 385 buffers and issues bus requests for received requests to access memory 213 via chip set 220. 3D renderer 360 renders graphics primitives received from memory 213

Vertex link FIFO 380 holds links to vertex FIFO/cache 340 such that the contents of each entry in FIFO 380 is a pointer to one of the vertex cache tags stored in FIFO/cache 340 while graphics accelerator 222 is operating in the random mode. In the sequential indirect streaming mode, each vertex link FIFO 380 entry relates to data words in FIFO/cache 340, rather than a vertex. According to one embodiment, each entry points to a 4 data word chunk. Thus, each entry points to points to a storage set in FIFO/cache 340 that holds the data word chunk.

According to one embodiment, links FIFO 380 allocates an entry every time a vertex is processed by a LOOKUP process (described below). FIFO 380 releases the entry after the READ process delivers the entire vertex to 3D renderer 360. The entries are allocated and evicted in order, as the vertices are referenced in the command stream. In the random indirect streaming mode, each FIFO 380 entry represents a vertex and points to the tag that points to the cache set that holds this vertex. According to one embodiment, vertices may be repeatedly used (e.g., more than one FIFO 380 entry may be linked to a single cache set). The number of entries in the links FIFO 380 dictates the depth of the pipeline between the READ process and the LOOKUP process.

As described above, graphics accelerator 222 may operate in either an inline streaming mode or indirect streaming mode for 3D graphics accesses. While a command is buffered in FIFO 325, it is determined whether the command uses an inline indirect vertex stream. If it is determined that the command includes an inline stream, graphics accelerator 213 operates in a manner similar to system 100 described above. However, if it is determined that the command includes an indirect command stream, graphics accelerator 213 operates in the random or sequential indirect streaming mode, depending upon the command.

Figure 4:
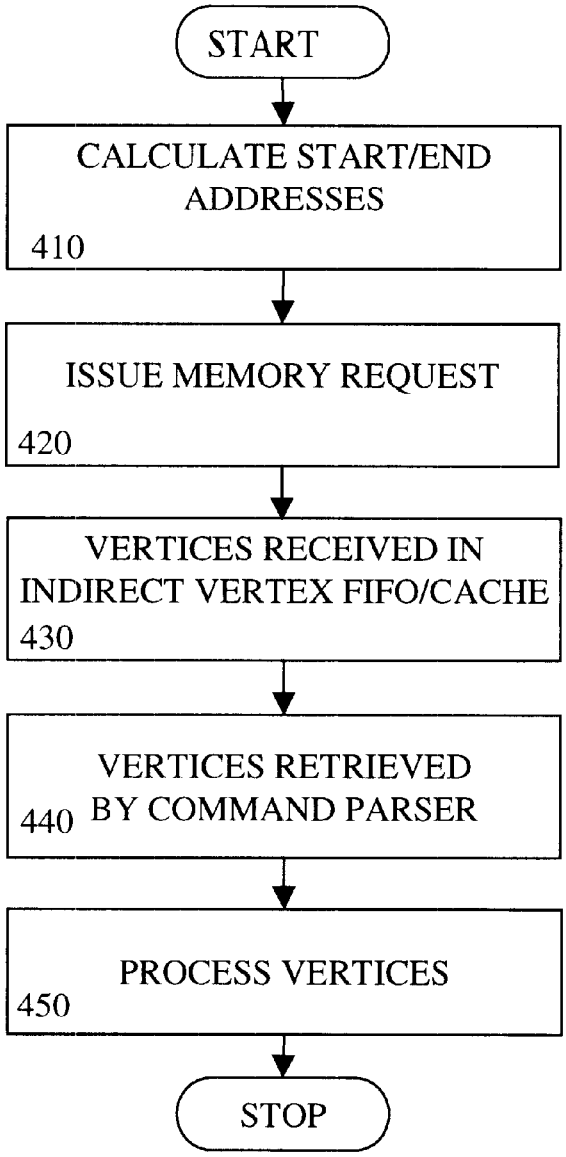
FIG. 4 is a flow diagram of one embodiment for the operation of sequential indirect streaming mode.
Figure 7:
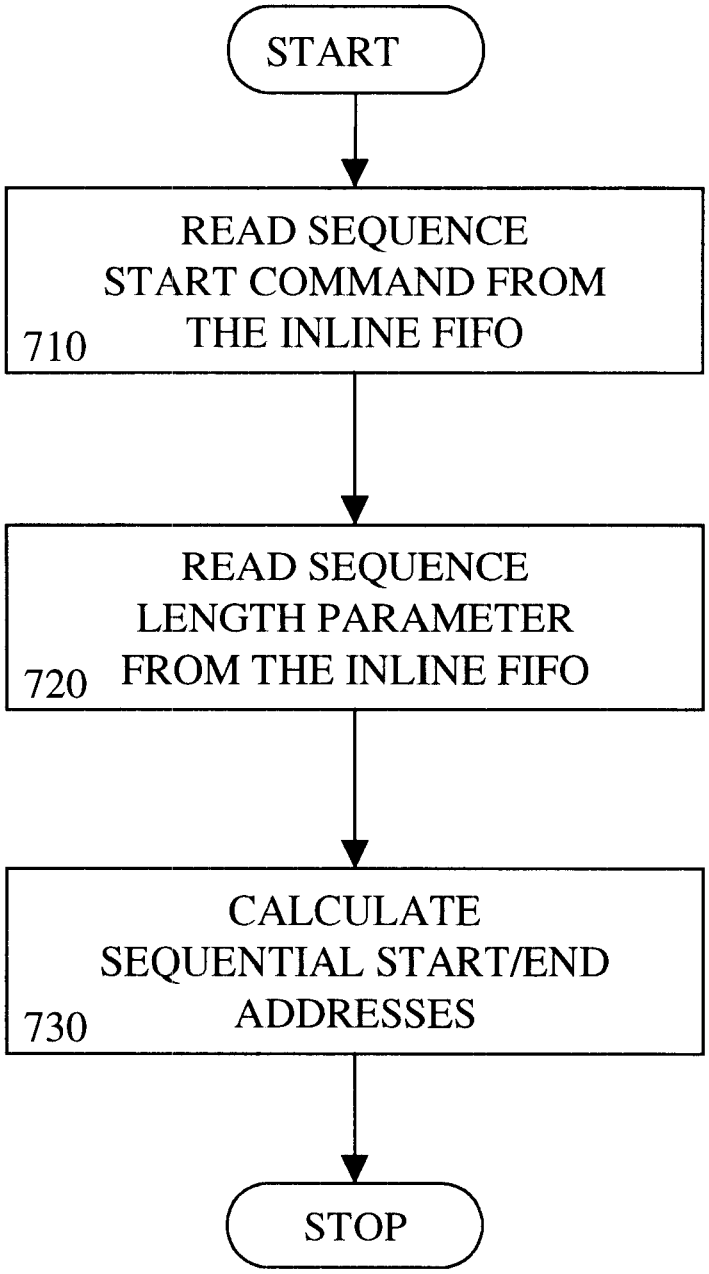
FIG. 7 is a flow diagram of one embodiment of the operation for an address calculator calculating starting and ending addresses.

FIG. 4 is a flow diagram of one embodiment for the operation of sequential indirect streaming. At process block 410, address calculator 345 calculates the starting and ending address locations in memory 213 of the first vertex in the request and the number of vertices to be fetched. FIG. 7 is a flow diagram of one embodiment of the operation for address calculator 345 calculating starting and ending addresses. At process block 710, a starting command for the sequence is read from inline FIFO 325. At process block 720, the length parameter of the sequence is read from inline FIFO 325. At process block 730, the sequential starting and ending addresses are calculated.

Figure 8:
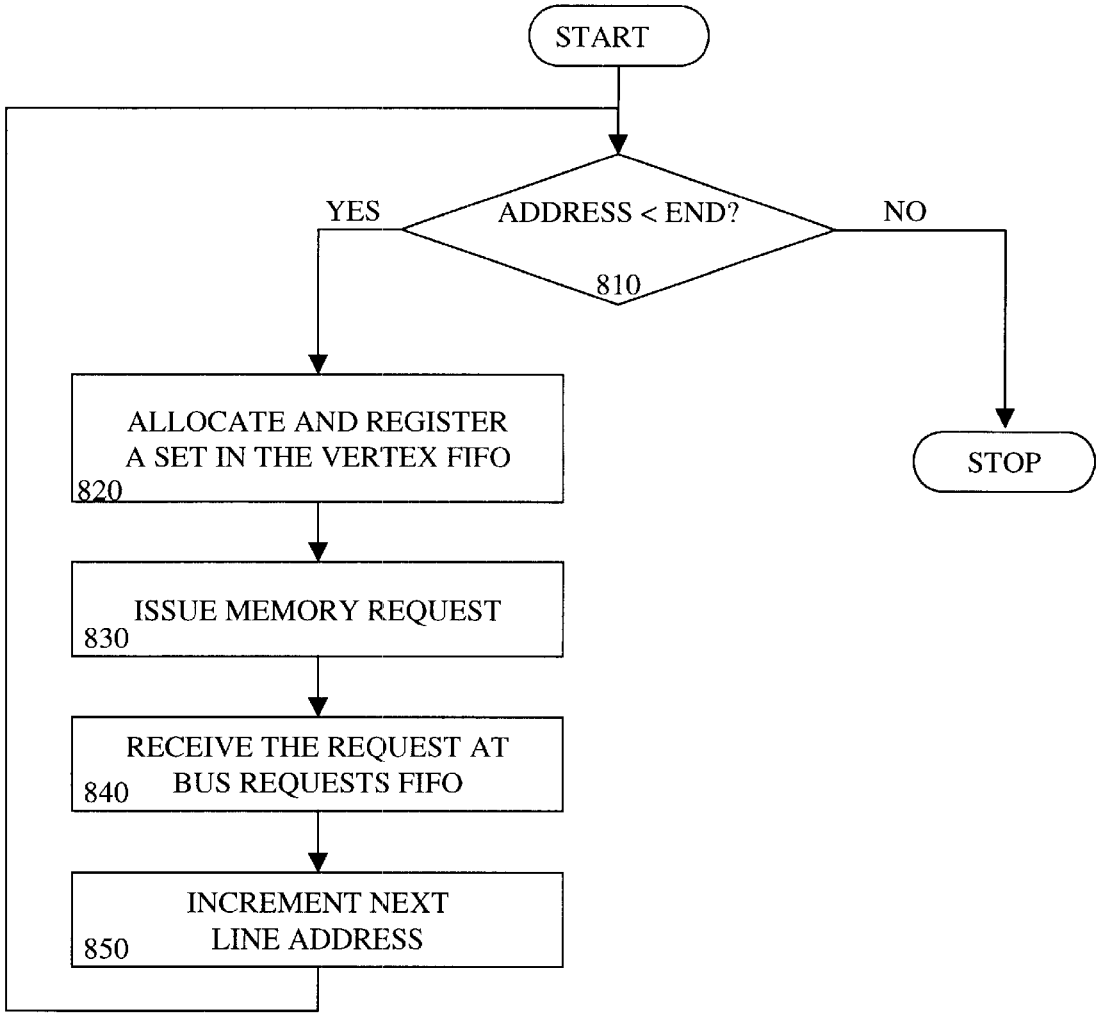
FIG. 8 is a flow diagram of one embodiment of the operation of bus request FIFO 385 issuing a bus request.

Referring back to FIG. 4, a request to access memory 213 via chip set 220 is issued by bus request FIFO 385 at process block 420. FIG. 8 is a flow diagram of one embodiment of the operation of bus request FIFO 385 issuing a bus request. At process block 810, it is determined whether the address to be accessed is less than the ending address. If the address to be accessed is less than the ending address, a storage set is allocated and registered in FIFO/cache 340, process block 820. At process block 830, a memory request is issued at address calculator 345. At process block 840, the request is received at bus requests FIFO 385. At process block 850, the next line address is incremented. Subsequently, control is returned to process block 810 where it is determined whether the next address is less than the ending address. If the address is equal to or greater than the ending address the process comes to an end.

Figure 9:
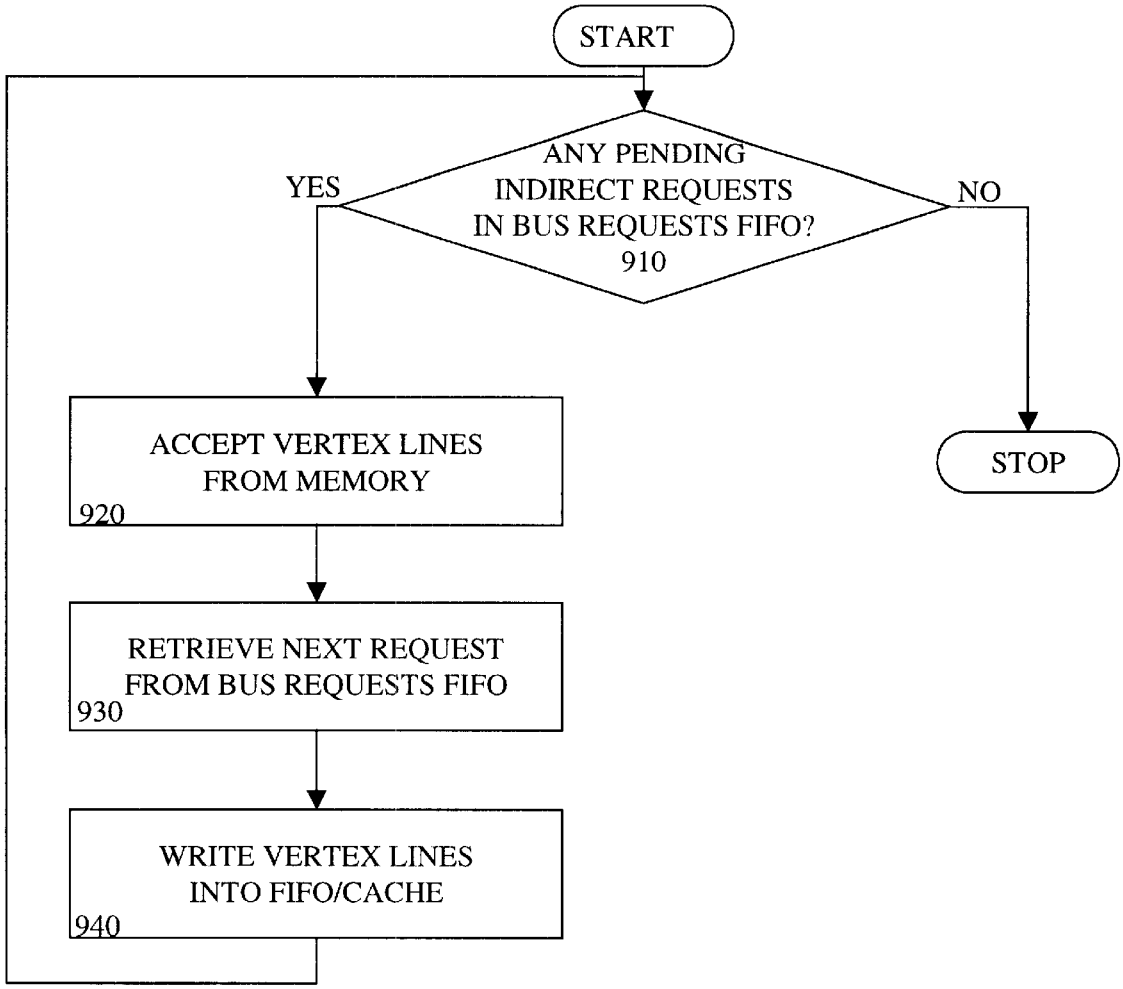
FIG. 9 is a flow diagram of one embodiment of the operation of receiving vertices at a FIFO/cache.

Referring back to FIG. 4, the vertices are retrieved from memory 213 at the locations indicated by address calculator 345 and received into indirect vertex FIFO/cache 340 at process block 430. FIG. 9 is a flow diagram of one embodiment of the operation of receiving vertices at FIFO/cache 380. At process block 910, it is determined whether there are any pending indirect requests at bus requests FIFO 385. If there are remaining indirect requests, vertex lines are accepted from memory 213, process block 920. At process block 930, the next request from bus requests FIFO 385 is retrieved. At process block 940, vertex lines are written into FIFO/cache 340. Subsequently, control is returned to process block 910 where it is determined whether there are any pending requests at bus requests FIFO 385. If there are no further requests pending at bus requests FIFO 385 the process comes to an end.

Figure 10:
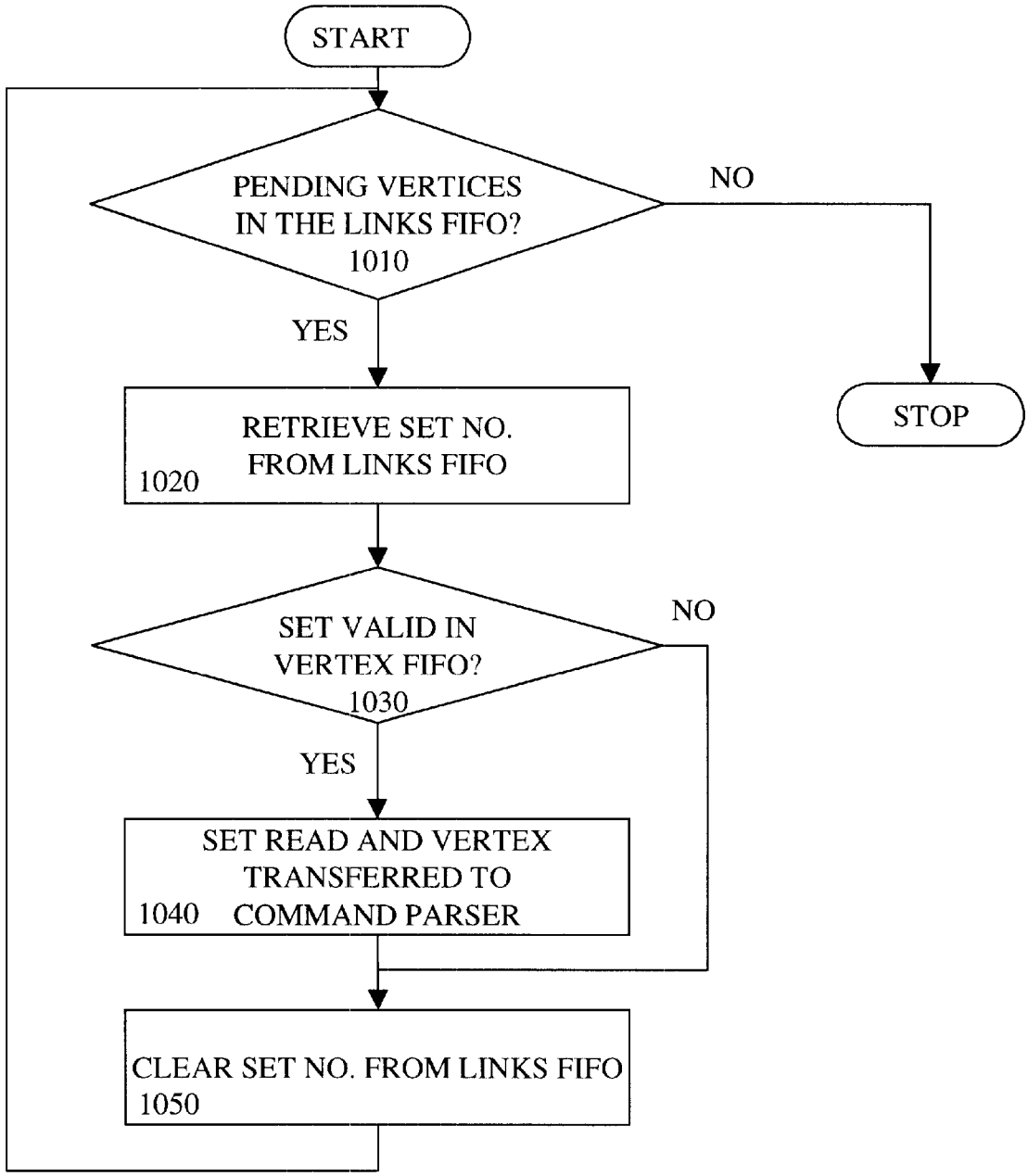
FIG. 10 is a flow diagram of one embodiment of the operation of retrieving vertices at a command parser.

Referring back to FIG. 4, the vertices are retrieved by command parser 330 at process block 440. FIG. 10 is a flow diagram of one embodiment of the operation of retrieving vertices at command parser 330. At process block 1010, it is determined whether the pending vertices are in link FIFO 380. If the pending vertices are in link FIFO 380, the storage set number is retrieved from links FIFO 380, process block 1020. At process block 1030, it is determined whether the storage set is valid. If the storage set is valid, the storage set is read and the vertex is transferred to command parser 320, process block 1040. At process block 1050, the storage set is cleared from link FIFO 380. If the storage set is invalid, control is forwarded to process block 1050 where the storage set is cleared from link FIFO 380.

Referring back to FIG. 4, command parser 330 forwards the vertices to 3D renderer 360 for processing at process block 450. Referring back to FIG. 3, vertex FIFO/cache 340 operates as a cache in the random indirect streaming mode, as described above. Indirect vertex FIFO/cache 340 is used to store vertices in the random indirect mode in order to enable processor 205 to retrieve vertices without accessing memory 213. The vertices are stored in the vertex FIFO/cache 340 to be delivered to command parser 330 upon request. According to one embodiment, FIFO/cache 340 is a fully associative cache organized in vertex size blocks (e.g., the size of each storage set is large enough to contain a full vertex).

In addition, FIFO/cache 340 is adaptive so that the size of the storage set changes according to the vertex size. In an adaptive vertex cache the number of sets increase as the size of the vertex decrease, allowing for an optimal utilization of the cache. For example, an adaptive cache of 48 words and 20 tags may contain 20 sets of 1 word vertices or 8 sets of 12 words for the largest vertex format.

According to one embodiment, in order to maintain coherency with the external memory, the vertex cache is flushed whenever the size of the vertex or the parameters of the vertex buffer change. In other words, as long as the vertex format and vertex buffer location are not explicitly changed it is possible to hit vertices from previous primitives.

Figure 5:
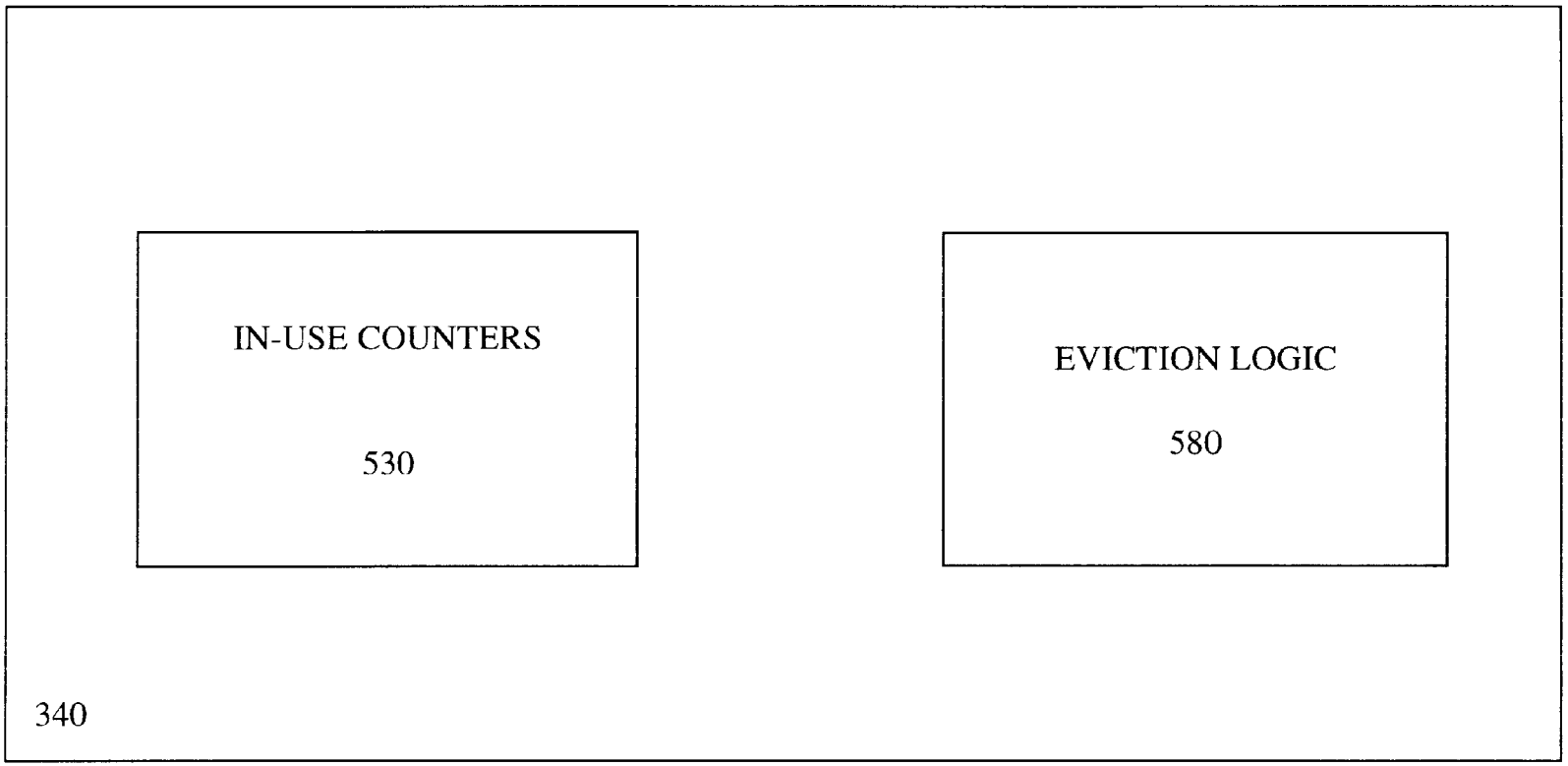
FIG. 5 is a block diagram of one embodiment of FIFO/cache.

FIG. 5 is a block diagram of one embodiment of FIFO/cache 340. FIFO/cache 340 includes in-use counters 530 and eviction logic 580 for use in the random access mode. In-use counters 530 are used to determine how often a particular storage set of vertices have been used in FIFO/cache 346 in order to evict a set for replacement by a new set of vertices. Instead of going over a particular set's links to vertex links FIFO 380, each set's tag is given a counter that increments whenever a link is created and decrements when the link is removed. The maximum in-use level (e.g., the value of the in-use counters) are smaller or equal to the occupancy of links FIFO 380. For instance, in an application having an 8-entry FIFO, 3-bit in-use counters may be implemented. In such a case, it would be possible to pipeline 8 consecutive vertices, in a mix of hits and misses.

According to one embodiment, a cache set, and specifically its tag, is valid if either the first line of the set is valid or if the set is in-use. The validity of the tag does not imply that the set's data is valid, as a set may be in-use while none of its lines are valid in case it is a newly allocated set after a cache miss, waiting for the lines to return from memory 213. A cache set may hold a valid vertex and not be in use, and that happens when the vertex remains in FIFO/cache 340 after being read and transferred to 3D renderer 360. Once a set is not in-use (e.g., when it is not linked to any vertex in process), it is a potential candidate for eviction by eviction logic 580. The typical policies for eviction are random.

Eviction logic 580 evicts vertex storage sets that are not being used. According to one embodiment, eviction logic 580 uses a pseudo-random format for eviction. Pseudo-random eviction relies on a modulo-N clock counter (not shown), where N is the number of storage sets in the vertex cache. The counter pseudo-randomly selects a set that is the starting point for a search. As a result, eviction logic 580 searches from the starting point, in a circular manner, for the first set that is either invalid or not in-use. If all sets are in-use then the eviction process stalls. In order to avoid an infinite circular search, no search is conducted if all sets are in use.

According to another embodiment, a least recently used (LRU) format is used by eviction logic 580. In the LRU implementation, a signed most significant bit is added to in-use counters 530 to enable the decrementing of the counters below the zero value. The positive values are in-use values while the negative ones are LRU values. Whenever a set stops being in use (e.g., whenever its in-use counter is decremented below zero), all other negative LRU counters are decremented as well, thus preserving the information about the age of the unused sets. When looking for a candidate for eviction, the set with the lowest LRU value is the least recently used.

Notice that this is a not pseudo LRU algorithm but a real one. The only exception is the case in which there is more than one old set and there is no way of telling which one is the oldest. This happens because the decremented LRU values clip to the lowest value (e.g., 1111). When searching for the least recently used set, several sets may have the lowest LRU value, and in such a case one of them is arbitrarily picked for replacement.

Figure 6:
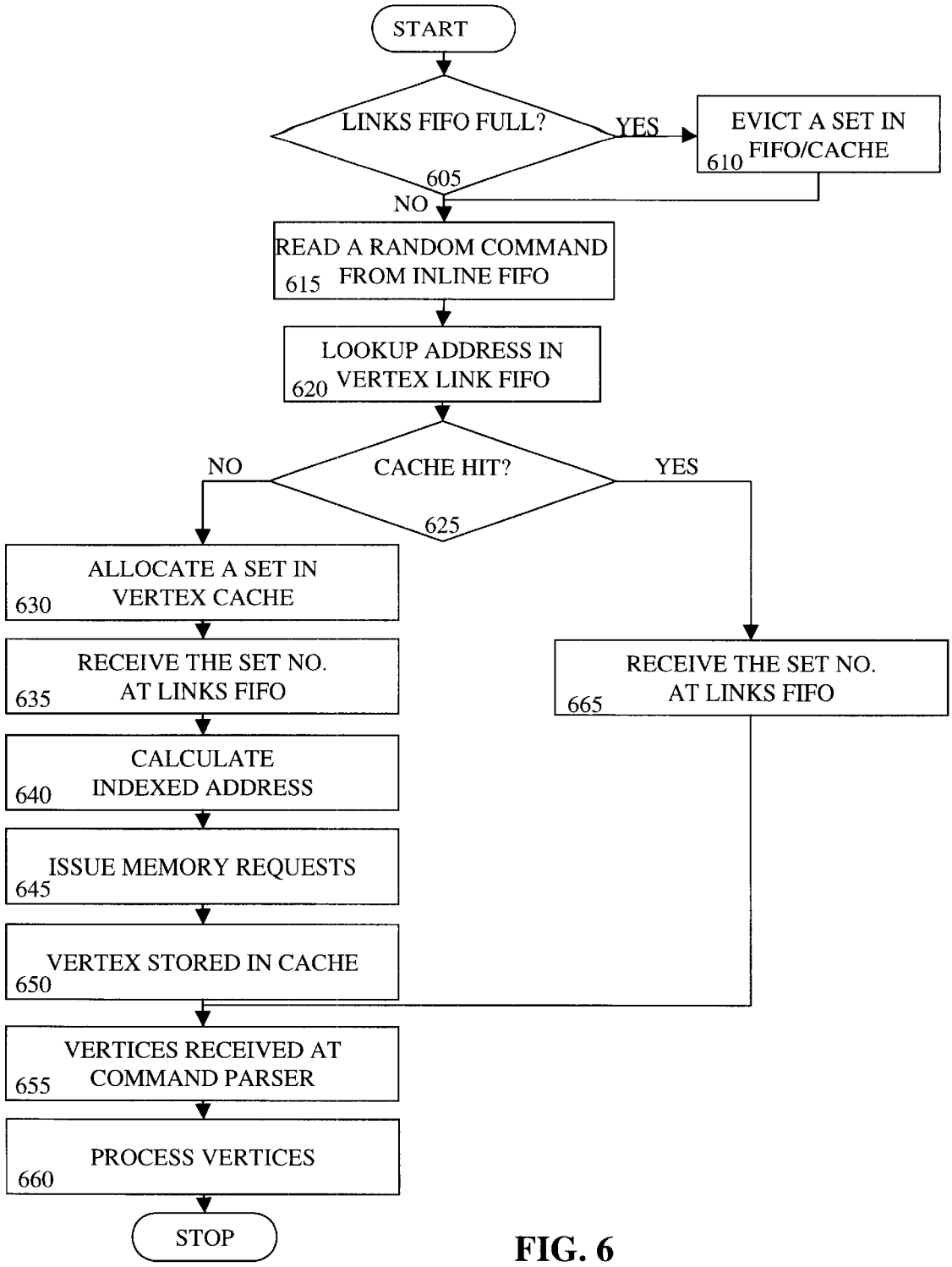
FIG. 6 is a flow diagram of one embodiment of a random indirect streaming.

FIG. 6 is a flow diagram of one embodiment for the operation of random indirect streaming. At process block 605, it is determined whether link FIFO 380 is full. If link FIFO 380 is full, a storage set is evicted from link FIFO/cache 340, process block 610. If link FIFO 380 is not full, a random command is read from inline FIFO 325, process block 615. At process block 620, the vertex addresses corresponding with the command is looked up in link FIFO 380. At process block 625, it is determined whether there is a cache hit (e.g., whether the entry in link FIFO 380 points to vertices stored in FIFO/cache 340).

Figure 11:
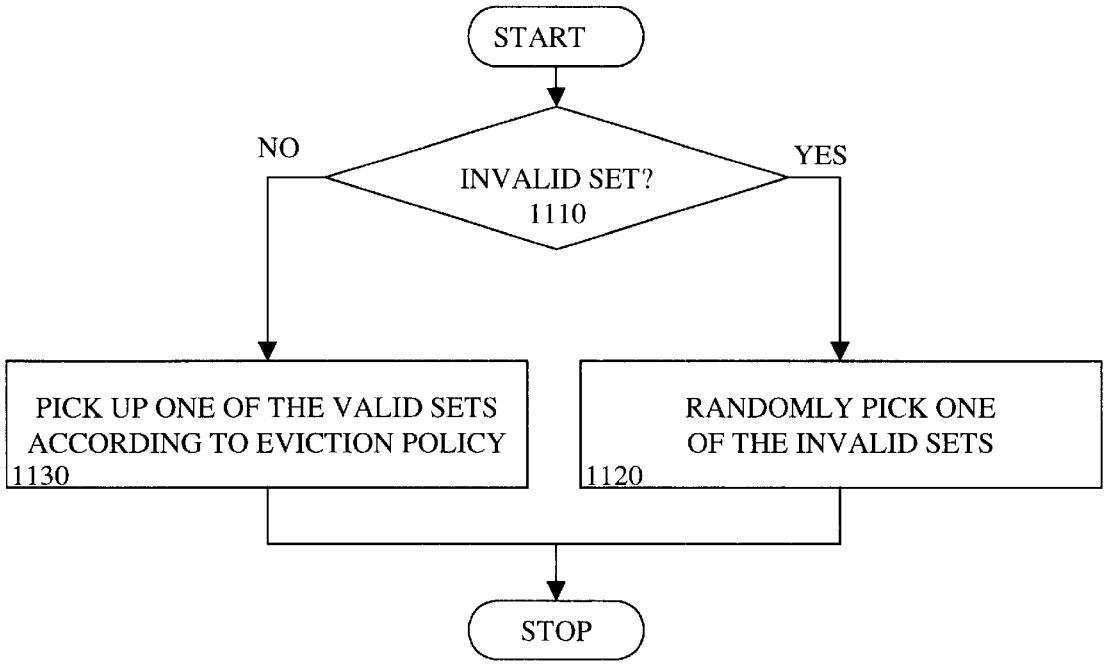
FIG. 11 is a flow diagram of one embodiment of the operation for allocating a storage set.

If there is not a cache hit, a storage set is allocated in FIFO/cache 340, process block 630. FIG. 11 is a flow diagram of one embodiment of the operation for allocating a storage set in FIFO/cache 340. At process block 1110, it is determined whether any storage sets are invalid. If there are invalid storage sets, one of the invalid storage sets are randomly chosen, process block 1120. However, if there are no invalid storage sets, a valid storage set is chosen according to the eviction policy described above, process block 1130.

Referring back to FIG. 6, the storage set number is received at link FIFO 380 at process block 635. At process block 640, address calculator 345 calculates the starting and ending address locations in memory 213 of the first vertex in the request and the number of vertices to be fetched. The operation for calculating starting and ending addresses is discussed in FIG. 7 above. At process block 645, a request to access memory 213 via chip set 220 is issued by bus request FIFO 385. The operation of bus request FIFO 385 for issuing a bus request is described above in FIG. 8.

At process block 650, the vertices are retrieved from memory 213 at the locations indicated by address calculator 345 and received into indirect vertex FIFO/cache 340 (see FIG. 9 above). At process block 655, the vertices are retrieved by command parser 330 (see FIG. 10). At process block 660, command parser 330 forwards the vertices to 3D renderer 360 for processing.

If there is a cache hit, the storage set number is received at link FIFO 380 at process block 665. Subsequently, control is forwarded to process block 655 where the vertices are retrieved by command parser 330, and process block 660 where command parser 330 forwards the vertices to 3D renderer 360 for processing.

According to one embodiment, multiple vertices are pipelined at graphics accelerator 222 according to five stages. The pipelining process avoids stalls when streaming indirect vertices to 3D renderer 360. This is achieved by dividing the complex sequential maneuver into five de-coupled processes and buffering them appropriately so that each can run independently at its own pace. The processes include direct memory access (DMA), LOOKUP, ISSUE, WRITE and READ.

The DMA process is the mechanism used in the normal inline mode wherein new lines are fetched from the command buffer in memory 213 into the inline FIFO 325. FIFO 325 should be filled whenever below the FIFO's watermark. The LOOKUP process includes looking up an address in vertex link FIFO 380 based upon a command received from inline FIFO 325. In addition, on a FIFO/cache 340 miss a cache entry is evicted by eviction logic 580. Further, the LOOKUP process should allow at least one pending miss without blocking the next cache lookup.

The ISSUE process takes place if a cache miss occurs. If there is a cache miss, then the address of the vertex pointer is calculated and as many bus requests as needed are issued for memory 213. Since the memory line size is different than the vertex size, the smallest number of bus requests that exactly contain the required vertex is issued. Bus requests FIFO 580 may be as deep as the external bus pipeline. The WRITE process includes receiving vertex data from memory 213 and writing them to a pre-allocated set of FIFO/cache 340. According to one embodiment, the vertices are written sequentially in the cache set and the next pre-allocated set are moved in order to write the next vertex. According to one embodiment, the data written to FIFO/cache 340 is in written at the same rate as it arrives from memory 213.

For the READ process, the next vertex data word is supplied to 3D renderer 360 if 3D renderer 360 is free. According to one embodiment, the data is read from FIFO/cache 340 at the rate of 3D renderer 360 in order to overcome the FIFO/cache 340 read latency.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as the invention.

What is claimed is:

1. A computer system comprising:

a memory; and a graphics accelerator coupled to the memory, comprising:

a first buffer coupled to the memory; and a second buffer, coupled to the memory, to operate as a first in first out (FIFO) buffer and as a cache buffer, wherein the size of storage in the second buffer changes according to the size of data sets stored in the second buffer during the cache operation.

2. The computer system of claim 1 wherein the second buffer operates as the FIFO buffer whenever the graphics accelerator is operating in a sequential indirect streaming mode and operates as the cache buffer whenever the graphics accelerator is operating in a random indirect streaming mode.

3. The computer system of claim 2 wherein the first buffer is a direct memory access (DMA) FIFO buffer.

4. The computer system of claim 2 wherein the graphics accelerator processes three-dimensional (3D) graphics primitives stored in the memory according to an inline streaming mode and the indirect streaming mode.

5. The computer system of claim 2 wherein the graphics accelerator further comprises a link FIFO, wherein the link FIFO includes cache tags that point to data stored in the second buffer.

6. The computer system of claim 5 wherein the graphics accelerator further comprises:

an address calculator coupled to the link FIFO; and a bus request FIFO coupled to the address calculator and the memory.

7. The computer system of claim 5 wherein the graphics accelerator further comprises:

a command parser coupled to the first buffer and the second buffer; and a 3D renderer coupled to the command parser.

8. The computer system of claim 1 wherein the second buffer comprises:

a plurality of in-use counters; and eviction logic for evicting unused data stored in the second buffer whenever the second buffer is operating in the random indirect streaming mode.

9. The computer system of claim 8 wherein the eviction logic evicts data based on a pseudo random format.

10. The computer system of claim 8 wherein the eviction logic evicts data based on a least recently used format.

11. The computer system of claim 1 further comprising a chip set coupled to the memory and the graphics accelerator.

12. A graphics accelerator comprising:

a first buffer coupled to a memory; and a second buffer coupled to the memory to operate as a first in first out (FIFO) buffer and as a cache buffer, wherein the size of storage in the second buffer changes according to the size of data sets stored in the second buffer during the cache operation.

13. The graphics accelerator of claim 12 wherein the second buffer operates as the FIFO buffer whenever the graphics accelerator is operating in a sequential indirect streaming mode and operates as the cache buffer whenever the graphics accelerator is operating in a random indirect streaming mode.

14. The graphics accelerator of claim 13 wherein the first buffer is a direct memory access (DMA) FIFO buffer.

15. The graphics accelerator of claim 13 wherein the graphics accelerator processes three-dimensional (3D) graphics primitives stored in the memory according to an inline streaming mode and the indirect streaming mode.

16. The graphics accelerator of claim 13 wherein the second buffer comprises:

a plurality of in-use counters; and eviction logic for evicting unused data stored in the second buffer whenever the second buffer is operating in the random indirect streaming mode.

17. The graphics accelerator of claim 13 further comprising a link FIFO, wherein the link FIFO includes cache tags that points to data stored in the second buffer.

18. The graphics accelerator of claim 17 further comprising:

an address calculator coupled to the link FIFO; and a bus request FIFO coupled to the address calculator and the memory.

19. The graphics accelerator of claim 18 further comprising:

a command parser coupled to the first buffer and the second buffer; and a 3D renderer coupled to the command parser.

20. A method of processing a graphics command comprising:

determining whether the command is an indirect command; if so calculating a starting and ending address indicating a memory location of vertex data corresponding to the command;

retrieving the vertex data by issuing a request to access the memory;

allocating a storage set in the first buffer if an address to be accessed is less than the ending address; and processing the vertex data.

21. The method of claim 20 wherein the process of retrieving vertex data further comprises:

receiving the vertex data at a first buffer; and retrieving the vertex data from the first buffer at a command parser.

22. The method of claim 21 wherein the process of receiving the vertex data at the first buffer comprises:

accepting vertex lines from the memory if there are any pending requests at a second buffer; and writing the vertex lines into the first buffer.

23. The method of claim 20 wherein the process of calculating a starting and ending address comprises:

reading a start command; and reading a length parameter.

24. A method of processing a graphics command comprising:

determining whether the graphics command is an indirect command; if so determining whether a first buffer is full; if not reading the graphics command from a second buffer; and determining whether vertex data associated with the graphics command is stored in a third buffer.

25. The method of claim 24 further comprising evicting a storage set in the third buffer if the first buffer is full.

26. The method of claim 24 further comprising:

allocating a storage set in the third buffer if vertex data associated with the graphics command is stored in the third buffer; and receiving a number corresponding to the storage set at the first buffer.

27. The method of claim 26 wherein the process of allocating the storage set in the third buffer comprises:

determining whether there are any invalid storage sets; and, if so randomly selecting one of the invalid storage sets.

28. The method of claim 26 wherein the process of allocating the storage set in the third buffer comprises:

determining whether there are any invalid storage sets; and, if not selecting a valid storage set based upon an eviction policy.

29. The method of claim 31 wherein the process of retrieving vertex data comprises:

issuing a request to access the memory;

receiving the vertex data at a first buffer; and retrieving the vertex data from the first buffer at a command parser.

30. The method of claim 31 wherein the process of calculating a starting and ending address comprises:

reading a start command; and reading a length parameter.

31. The method of claim 24 further comprising:

calculating a starting and ending address indicating a memory location of vertex data corresponding to the graphics command;

retrieving the vertex data; and processing the vertex data.

32. The method of claim 29 wherein the process of issuing a request to access the memory comprises:

determining whether an address to be accessed is less than the ending address; and if so, allocating a storage set in the first buffer.

33. The method of claim 29 wherein the process of receiving the vertex data at the first buffer comprises:

determining whether there are any pending requests at a second buffer; if so, accepting vertex lines from the memory; and writing the vertex lines into the first buffer.

* * * * *

UNITED STATES PATENT AND TRADEMARK OFFICE

CERTIFICATE OF CORRECTION

PATENT NO. : 6,570,573 B1
DATED : May 27, 2003
INVENTOR(S) : Kazachinsky et al.

It is certified that error appears in the above-identified patent and that said Letters Patent is hereby corrected as shown below:

Column 7,
Line 57, delete “346”, insert -- 340 --.

Signed and Sealed this

Second Day of December, 2003

JAMES E. ROGAN
*Director of the United States Patent and Trademark Office*